US006017427A

United States Patent [19]

Yamamoto

[11] Patent Number: 6,017,427

[45] Date of Patent: Jan. 25, 2000

[54] APPARATUS FOR TESTING HIGH SPEED ELECTROPLATING

[75] Inventor: Tatsuo Yamamoto, Tokyo, Japan

[73] Assignee: Yamamoto-MS Co., Ltd., Tokyo, Japan

[21] Appl. No.: 09/064,185

[22] Filed: Apr. 22, 1998

[30] Foreign Application Priority Data

Dec. 2, 1997 [JP] Japan ..... 9-331454

[51] Int. Cl.[7] ..... C25D 17/00

[52] U.S. Cl. ..... 204/212

[58] Field of Search ..... 204/212, DIG. 7

[56] References Cited

U.S. PATENT DOCUMENTS 3,168,457 2/1965 Grazen ..... 204/212
4,102,770 7/1978 Moriarity et al. ..... 204/212
5,228,976 7/1993 Abys et al. ..... 204/212
5,268,087 12/1993 Lu ..... 204/212

*Primary Examiner*—Kathryn Gorgos
*Assistant Examiner*—Thomas H Parsons
*Attorney, Agent, or Firm*—Liniak, Berenato, Longacre & White

[57] ABSTRACT

An apparatus for testing high speed electroplating having a small size and a simple construction comprising a tank having an inclined portion formed on the bottom surface, a metal plate for the anode placed on said inclined portion, a metal rod for the cathode held by a motor which can rotate along the side of the tank opposite to said metal plate for the anode, a metal plate for the cathode wound around said metal rod for the cathode, and a DC power supply connected to said metal plate for the anode and to said metal rod for the cathode can simulate the state of the high speed electroplating.

2 Claims, 4 Drawing Sheets

APPARATUS FOR TESTING HIGH SPEED ELECTROPLATING

BACKGROUND OF THE INVENTION

1. Field of the Invention

The present invention relates to an apparatus for testing high speed electroplating to which a Hull cell test tank is applied.

2. Prior Art

At present, plating is applied on the surface of a metal in various fields in daily life. Plating is required to be carried out in a plating bath having a composition suitable for the plating to be carried out under the optimal electrodeposition conditions of current density, agitation speed, temperature of the plating liquid, etc. Usually, even if plating is started under optimal conditions, the composition of the plating bath is gradually changed as plating is continued. Moreover, predicted impurities and unexpected impurities are incorporated, leading to a change in the characteristics of a plated film to be required.

Accordingly, it is required for constantly obtaining the best plated film to maintain the optimum bath composition and electroplating conditions at all times. According to the change in the composition of the plating liquid, the addition of chemicals, removal of the impurities, adjustment of the various conditions such as current density are required in addition to the prediction of change in the bath composition. Consequently, it is necessary to well understand the conditions of fresh plating liquid and the conditions of the plating liquid which is now used.

For understanding the conditions of the plating liquid, chemical analysis such as titration or instrumental analysis such as ion chromatographic analysis is carried out. Further, a plating test method, which is called a Hull cell test, has been widely used for total research of the characteristics of plating liquid, and observation of the states of electroplating as well as examination and management of the bath composition of the presently used plating liquid and electrodeposition conditions.

FIGS. 4 and 5 show the testing apparatus for use in the Hull cell test.

FIG. 4 shows a tank to be used in the Hull cell test. The tank 20 is formed so that the horizontal section is a trapezoid. On the oblique side 22 and the vertical side 22 of the trapezoid, a cathode plate 23 and an anode plate 24 are placed, respectively. The tank is filled with an electrolyte 25. The characteristic of the tank 20 is to place the cathode plate 23 inclined to the anode 24 so that the distance between one end of the cathode plate 23 and the anode plate 24 is different from the distance between the other end of the cathode plate 23 and the anode 24. Accordingly, when plating is carried out in an electric circuit as shown in FIG. 5, there are differences in the cathode current densities at both ends of the cathode plate 23. As a result, the state of the deposition of plate at every cathode current density can be observed on one test piece. From the test piece (cathode 23) obtained by the test, the total research of the characteristics and the total observation of the states of the plating liquid in the electroplating can be carried out and, at the same time, the bath composition of the plating liquid and the conditions of the electrodeposition can be examined and managed.

Usually, in the case where electroplating is carried out using a new plating liquid at the beginning the Hull cell test is carried out with the previous conditions to understand the characteristics of the plating liquid, and then the optimum electrodeposition conditions for obtaining a desired plated film, such as the range of the current density, the range of the temperature, and stirring conditions are examined.

When a new plating tank, a new power supply, or the like is placed, the design of the equipment is carried out according to the optimum conditions based on the results of the previous Hull cell test in some case, but the conditions of the plating equipment which has been already used is simulated by the Hull cell test in many cases. In this case, the optimum conditions are groped by changing the temperature conditions or adding a chemical as occasion may demand.

Moreover, by carrying out the Hull cell test utilizing a plating liquid before use and the plating liquid after use, respectively, the proportion of change in the plating liquids before use and after use can be examined. This makes it possible to predict the bath composition of the plating liquid which will be changed in the future under the conditions and the states of the plated film.

However, in the conventional Hull cell test, the test is carried out in a stationary state of the cathode plate 23 of the substance to be plated or even if the cathode plate 23 is reciprocated by relatively moving the plating bath by means of a reciprocating device, the reciprocation speed in the Hull cell test is at most approximately 5 m/minute. What is more, the Hull cell test can only test the electroplating operated at several Amps over a period of several minutes. Consequently, the Hull cell test is disadvantageous in that it is applicable to testing neither plating of electric parts called hoop plating, which has been popularized in recent years nor high speed electroplating, which is carried out by continuously plating wires produced from an iron factory or an electric wire maker at a high speed. To be specific, high speed electroplating is a method of instant plating at a high current as high as several Amps times ten by moving a substance to be plated at a high speed, which is at most 120 m/minute. Accordingly, in order to simulate such a state, a large-sized testing apparatus is required and, thus, the conventional Hull cell test which utilizes a small sized and simple apparatus cannot be applied.

SUMMARY OF THE INVENTION

The present invention has been completed in light of the situations described above, and an object of the present invention is to provide an apparatus for testing high speed electroplating which can simulate the state of the high speed electroplating by the use of a small-sized and relatively simplified testing apparatus.

The present invention relates to an apparatus for testing high speed electroplating which comprises a tank having an inclined portion formed on the bottom surface; a metal plate for the anode placed on said inclined portion; a metal rod for cathode held by a motor which can rotate along the side of the tank opposite to said metal plate for the anode; a metal plate for the cathode wound around said metal rod for the cathode; and a DC power supply connected to said metal plate for the anode and to said metal rod for the cathode.

In the apparatus for testing high speed electroplating according to the present invention, the bottom surface of said tank is preferably formed in a V-shape.

BRIEF DESCRIPTION OF THE INVENTION

PREFERRED EMBODIMENT OF THE INVENTION

Figure 1:
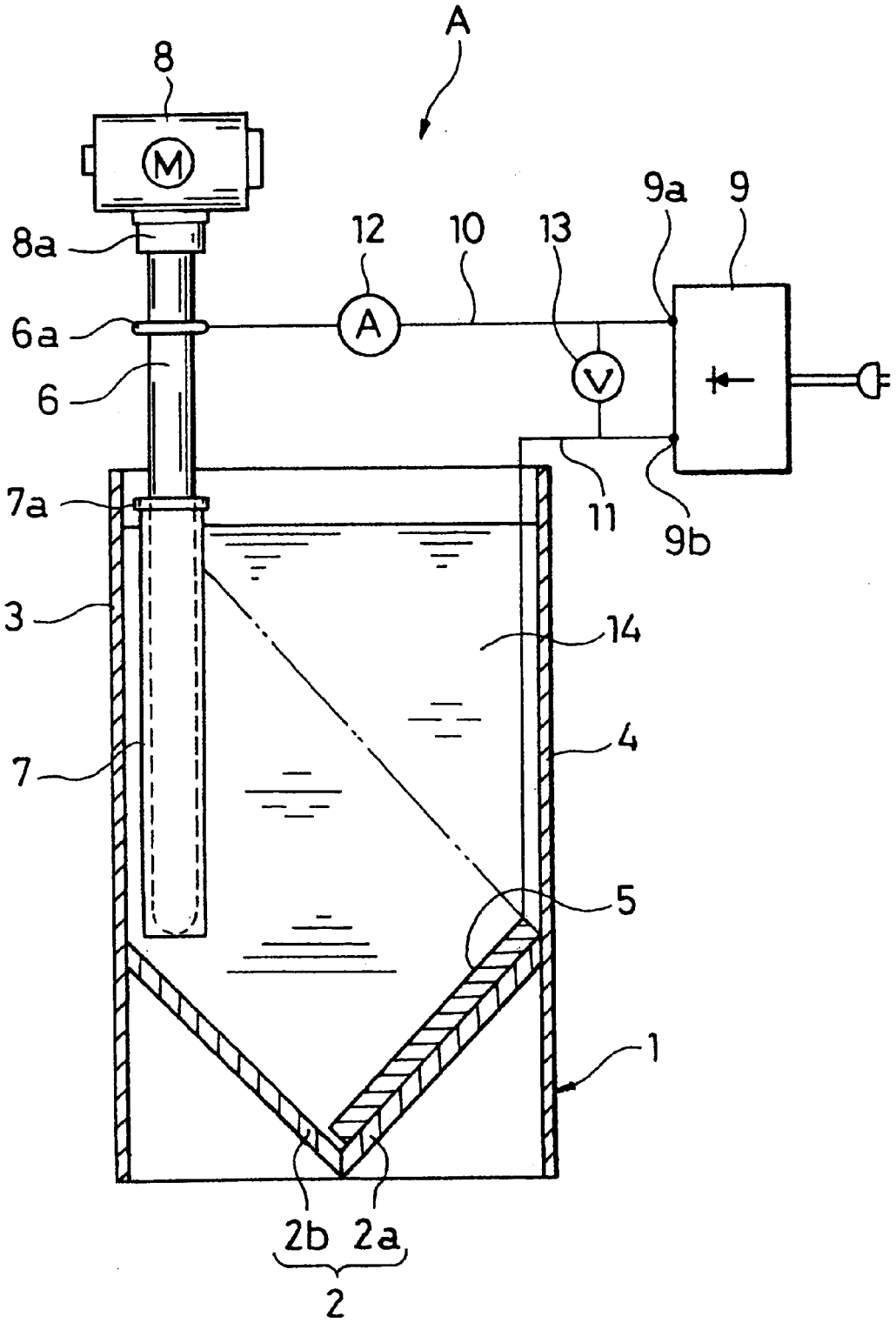
FIG. 1 is a drawing which explains the construction of the apparatus for testing high speed electroplating according to the present invention.

An embodiment of the apparatus for testing high speed electroplating according to the present invention will now be described by referring to the drawings.

Figure 2:
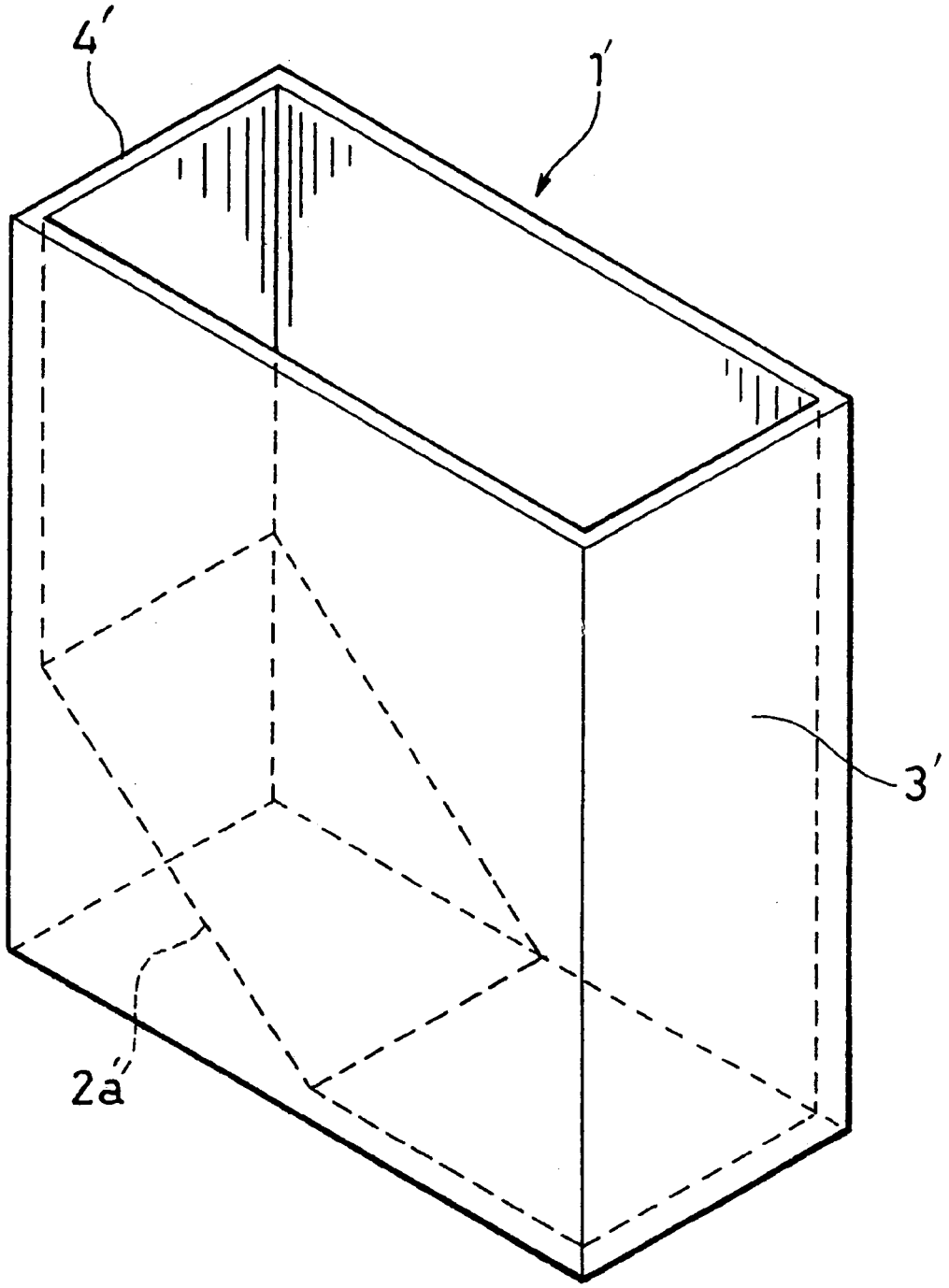
FIG. 2 is a perspective view showing the tank utilized in the apparatus for testing high speed electroplating according to the present invention.
Figure 3:
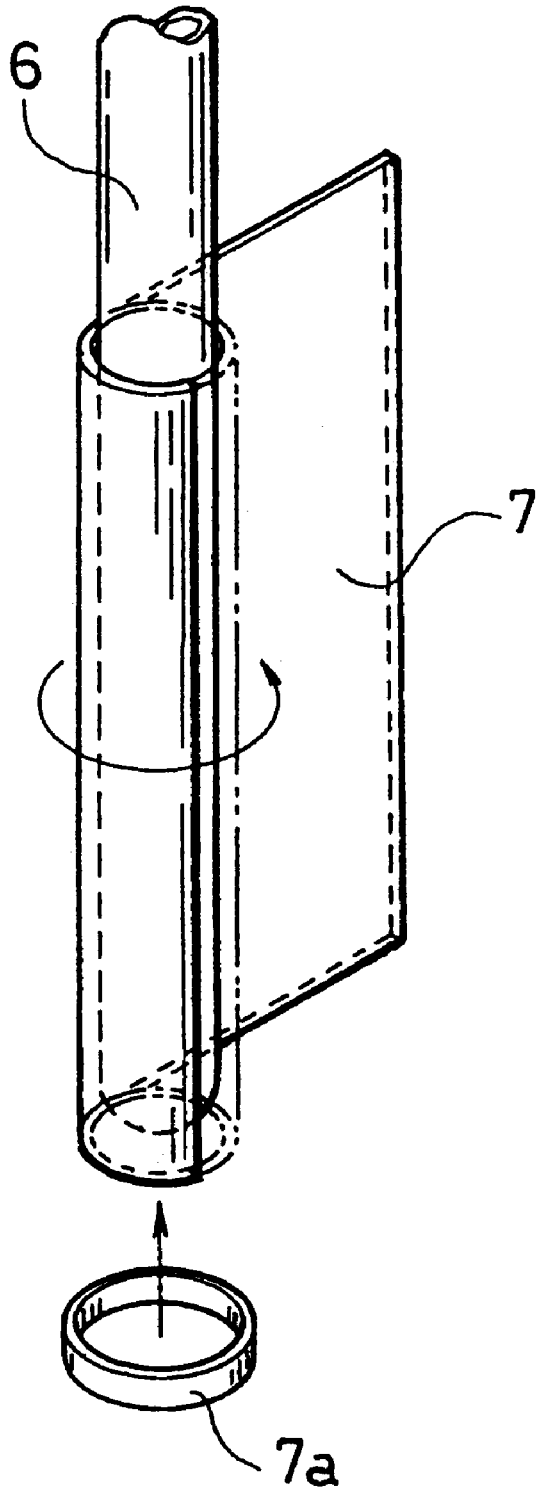
FIG. 3 is a perspective view showing the metal rod for cathode and the metal plate for anode of the apparatus for testing high speed electroplating of FIG. 1.
Figure 4:
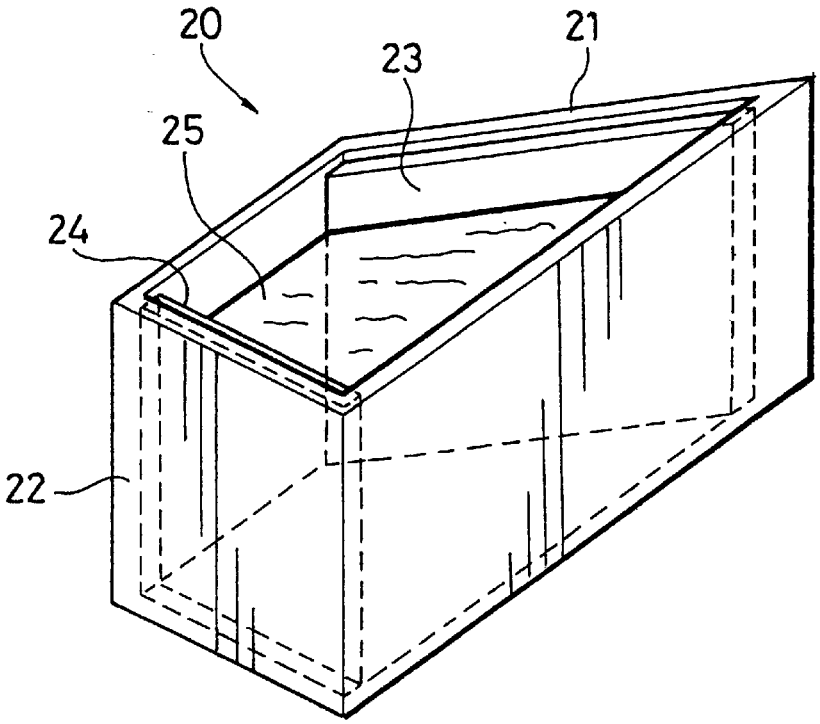
FIG. 4 is a perspective view showing the tank for use in the conventional Hull cell test.
Figure 5:
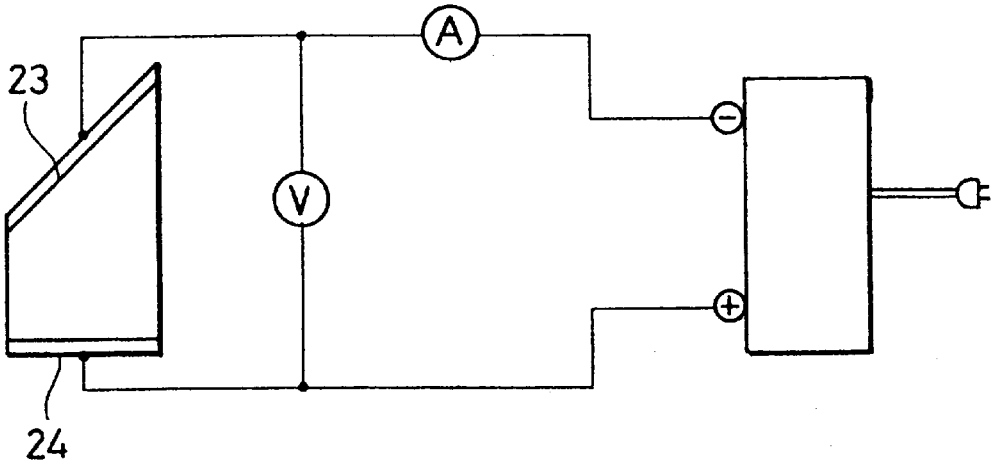
FIG. 5 is an apparatus for Hull cell test.

FIG. 1 is a drawing which explains the construction of the apparatus for testing high speed electroplating according to the present invention, FIG. 2 is a perspective view showing the tank utilized in the apparatus for testing high speed electroplating according to the present invention, and FIG. 3 is a perspective view showing the metal rod for the cathode and the metal plate for the anode of the apparatus for testing high speed electroplating of FIG. 1.

As shown in FIG. 1, the apparatus A for testing high speed electroplating according to the present invention is mainly made up of a tank 1 having a bottom surface 2 formed in a V-shape and having a rectangle horizontal cross-section, a metal plate 5 for the anode placed on an inclined portion 2*a* which is one side of said V-shaped bottom surface 2, a metal rod 6 for the cathode held by a motor 8, which can rotate along the side 3 of the tank opposite to said metal plate 5 for the anode, a metal plate 7 for the cathode wound around said metal rod 6 for the cathode, and an eliminator 9 for DC power supply connected to the metal plate 5 for the anode and to the metal rod 6 for the cathode.

Wiring 10 is connected to the metal rod 6 for the cathode and the negative pole 9*a* of the eliminator 9 and an ammeter 12 for measuring the plating current is inserted into the wiring 10. The metal plate 5 for the anode and the positive pole 9*b* of the eliminator 9 are connected to wiring 11. A voltmeter 13 for measuring the voltage to be applied to the apparatus A for testing electroplating is inserted between the wiring 10 and the wiring 11.

The tank 1 for use in the apparatus A for testing electroplating is made of a synthetic resin material such as acrylic resin, propylene resin, or Teflon which is difficult to be corroded by the plating liquid 14. The tank 1 is a box having an external size of 100 mm in length, 70 mm in width and 150 mm in height, and has inclined portions 2*a*, 2*b* formed on the bottom surface 2 so that the angle formed by the inclined portions 2*a* and 2*b* is approximately 90 degrees. Also, as shown by numeral 1' in FIG. 2, the tank may be constructed so that only one inclined portion 2*a*' is formed on the bottom surface. In testing, the tank 1 or 1' is filled with a plating liquid by 80 to 90% of the depth of the tank.

In FIG. 1, as for the metal plate 5 for the anode placed on the inclined portion 2*a* of the tank 1, copper, tin, platinum, cobalt, or the like maybe used depending upon the kind of plating. The metal plate 5 for the anode is produced so as to match the size of the inclined portion 2*a*. The thickness of the metal plate 5 is approximately 2 mm, considering the consumption due to plating. To the upper end of the metal plate 5 for the anode is connected to the positive pole 9*b* of the eliminator 9 via the wiring 11.

The metal rod 6 for the cathode which is placed along the side 3 opposite to the metal plate 5 for the anode is an electrically conductive metal rod made of copper or brass and has a diameter of approximately 10 mm.

The upper end of the metal rod 6 for the cathode is held by the motor 8 so that the metal rod 6 for the cathode can be rotated by means of the drive shaft of the motor 8. The upper portion of the metal rod 6 for the cathode is connected to the wiring 10 via a slipping 6*a*, etc. The wiring 10 is connected to the negative pole 9*a* of the eliminator 9.

Also, the metal plate 7 for the cathode is wound around a lower portion of the metal rod 6 for the cathode. As shown in FIG. 3, the metal plate 7 for the cathode is a thin metal plate made of copper, brass, iron, stainless steel, aluminum, or the like and is wound around the metal rod 6 for the cathode once. A snap ring 7*a* is provided to fix the metal plate 7 for the cathode on the metal rod 6 for the cathode in the wound state. Alternatively, the metal plate 7 for the cathode can be fixed on the metal rod 6 for the cathode by means of an electrically conductive adhesive (not shown).

The motor for rotating the metal rod 6 for the cathode is fixed by a supporting stand (not shown), and it holds the upper end of the metal rod 6 for the cathode by means of a joint 8*a* equipped on one end of the drive shaft thereof. The rotation speed of the motor 8 is variable within the range of from 0 to 2,000 rpm. For example, if a metal rod 6 for the cathode having a diameter of 10 mm is used, it is possible to make conditions of the high speed electroplating which can move the rod at a speed as high as at most 60 m/minute. Electroplating operated at a higher speed can be simply tested by increasing the diameter of the metal rod 6 for the cathode. Alternatively, electroplating operated at a still higher speed can be tested by using a high speed motor or using accelerating gears The eliminator 9 which supplies electric power to the apparatus A for testing high speed electroplating is a commonly known eliminator having an eliminator circuit such as a diode bridge circuit, as well as a smoothing circuit, accommodated therein and has the ability of outputting DC voltage in the range of from 0 to 20 V and the ability of outputting electric current in the range of from 0 to 30 Amps.

The procedure for testing plating using the apparatus A for testing high speed electroplating thus constructed will now be described.

First, the metal plate 5 for the anode and the metal plate 7 for the cathode are pretreated such as degreased and washed with an acid. The metal plate 5 for the anode is placed on the tank 1 filled with the plating liquid 14. The metal plate 7 for the cathode is wound around the metal rod 6 for the cathode, which has been previously removed from the motor 8, once, and fixed thereon by means of the snap ring 7*a*.

Next, the metal rod 6 for the cathode is provided on the joint 8*a* of the motor 8, and set on the tank 1 at the position opposite to the metal plate 5 for the anode.

Subsequently, the slip ring 6*a* is set to the metal rod 6 for the cathode, the wiring 10 is connected to the negative pole 9*a* of the eliminator 9, and the wiring 11 of the metal plate 5 for the anode is connected to the positive pole 9*b* of the eliminator 9.

Subsequently, the rotation number of the motor 8, and the voltage and current of the eliminator 9 are adjusted to meet the kind of plating to be tested, and the power supply is turned on to operate the apparatus A for testing high speed electroplating for a prescribed period (approximately 10 to 40 seconds).

After the operation for the prescribed period, the power supply of the apparatus A for testing high speed electroplating is shut off. The metal rod 6 for the cathode is lifted and taken out from the motor 8, and the metal plate 7 for the cathode is taken out of the metal rod 6 for the cathode. The curled metal plate 7 for the cathode is spread to be flatted.

When the metal plate 7 for the cathode is analyzed similar to the Hull cell test, the conditions of deposition of plate, the composition of plating bath, and various electrodeposition conditions which have been set such as the temperature and revolving number can be analyzed.

In the apparatus A for testing high speed electroplating constructed as described above, when the metal rod 6 for the cathode is rotated at a prescribed rotation speed, the metal plate 7 for the cathode wound around the metal rod 6 for the cathode is in the state similar to the state of the high speed movement. Accordingly, the state of the high speed electroplating can be simulated.

As is clear from the description described above, according to the present invention, the apparatus for testing high speed electroplating comprising a tank having an inclined portion formed on the bottom surface; a metal plate for the anode placed on said inclined portion; a metal rod for the cathode held by a motor which can revolve along the side of the tank opposite to said metal plate for the anode; a metal plate for the cathode wound around said metal rod for the cathode, and a DC power supply connected to said metal plate for the anode and to said metal rod for cathode has the advantages that the substance to be plated can be moved at a high speed and, thus, the state of the high speed electroplating can be simulated by a small sized and relatively simple apparatus.

Moreover, when the bottom surface of the tank is formed in a V-shape, the relative relationship of the positions between the metal plate for the anode and the metal plate for the cathode is the same as that of the Hull cell test. The electrodeposition conditions can be analyzed with high accuracy.

What is claimed is:

1. An apparatus for testing high speed electroplating which comprises:

a tank having an inclined portion formed on the bottom surface;

a metal plate for an anode placed on said inclined portion;

a metal rod for a cathode held by a motor which can rotate said metal rod for the cathode along the side of the tank opposite to said metal plate for the anode;

a metal plate for the cathode which is wound around said metal rod for the cathode; and a DC power supply connected to said metal plate for the anode and to said metal rod for the cathode.

2. The apparatus as claimed in claim 1, wherein the bottom surface of said tank is formed in a V-shape.

* * * * *